US008579403B2

(12) United States Patent
Otobe

(10) Patent No.: US 8,579,403 B2
(45) Date of Patent: Nov. 12, 2013

(54) LIQUID EJECTION APPARATUS HAVING MARKED BELT

(75) Inventor: Mutsumi Otobe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 235 days.

(21) Appl. No.: 13/051,856

(22) Filed: Mar. 18, 2011

(65) Prior Publication Data

US 2011/0242181 A1 Oct. 6, 2011

(30) Foreign Application Priority Data

Mar. 31, 2010 (JP) ..... 2010-083225

(51) Int. Cl.
*B41J 29/38* (2006.01)

(52) U.S. Cl.
USPC ..... 347/16

(58) Field of Classification Search
None
See application file for complete search history.

(56) References Cited

U.S. PATENT DOCUMENTS

| | | | | |
|---|---|---|---|---|
| 6,607,458 | B2 * | 8/2003 | Downing et al. | 474/102 |
| 2007/0045939 | A1 * | 3/2007 | Toya et al. | 271/198 |
| 2007/0236528 | A1 * | 10/2007 | Oike | 347/19 |
| 2010/0149242 | A1 * | 6/2010 | Takahashi et al. | 347/14 |

FOREIGN PATENT DOCUMENTS

| | | | | |
|---|---|---|---|---|
| JP | H02-175539 | A | | 7/1990 |
| JP | 2004-099248 | A | | 4/2004 |
| JP | 2006-062118 | A | | 3/2006 |
| JP | 2006062118 | A | * | 3/2006 |
| JP | 2006-154289 | A | | 6/2006 |
| JP | 2007-276286 | A | | 10/2007 |

OTHER PUBLICATIONS

Japan Patent Office, Notice of Reasons for Rejection for Japanese Patent Application No. 2010-083225, mailed Apr. 17, 2012.

* cited by examiner

*Primary Examiner* — Geoffrey Mruk
*Assistant Examiner* — Bradley Thies
(74) *Attorney, Agent, or Firm* — Baker Botts L.L.P.

(57) ABSTRACT

A recording apparatus includes a recording unit recording an image, an endless belt which is stretched between rollers such that the inner circumferential surface thereof contacts the rollers and the outer circumferential surface thereof opposes the recording unit, a mark arranged on the profile of the belt, and a mark detection unit which detects that the mark moving in accordance with the travel of the belt is positioned at a predetermined position.

8 Claims, 12 Drawing Sheets

LIQUID EJECTION APPARATUS HAVING MARKED BELT

CROSS REFERENCE TO RELATED APPLICATION

The present application claims priority from Japanese Patent Application No. 2010-83225, which was filed on Mar. 31, 2010, the disclosure of which is herein incorporated by reference in its entirety.

BACKGROUND OF THE INVENTION

1. Field of the Invention

The present invention relates to a recording apparatus having a mark used for detecting a predetermined position on a conveyance belt conveying a recording medium.

2. Description of the Related Art

Known technologies are arranged such that a predetermined position on a conveyance belt conveying sheets is detected in order to fix a region where ink is ejected when flushing is carried out. For example, according to a known technology, a position detection mark is provided on the inner circumferential surface of the conveyance belt, and a position on the conveyance belt is detected by detecting the mark by means of a sensor which is provided at a region where the mark passes through.

SUMMARY OF THE INVENTION

According to the known technology, the position detection mark is provided on the inner circumferential surface of the conveyance belt, and hence the mark may be worn out due to repeated contact with a roller. This causes a problem in that the sensor cannot properly detect the mark. To solve this problem, a protective layer is provided to cover the position detection mark. This, however, does not eliminate the problem of the wear of the protective layer and the mark.

A main object of the present invention is to provide a recording apparatus which can properly detect a mark on a conveyance belt while the wear of the mark is restrained.

A recording apparatus of the present invention includes: a recording unit recording an image; an endless belt stretched between a plurality of rollers so that an inner circumferential surface of the belt contacts the plurality of rollers whereas an outer circumferential surface of the belt opposes the recording unit; a mark which is arranged on a profile of the belt; and a mark detection unit which detects that the mark moving in accordance with travel of the belt is positioned at a predetermined position.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
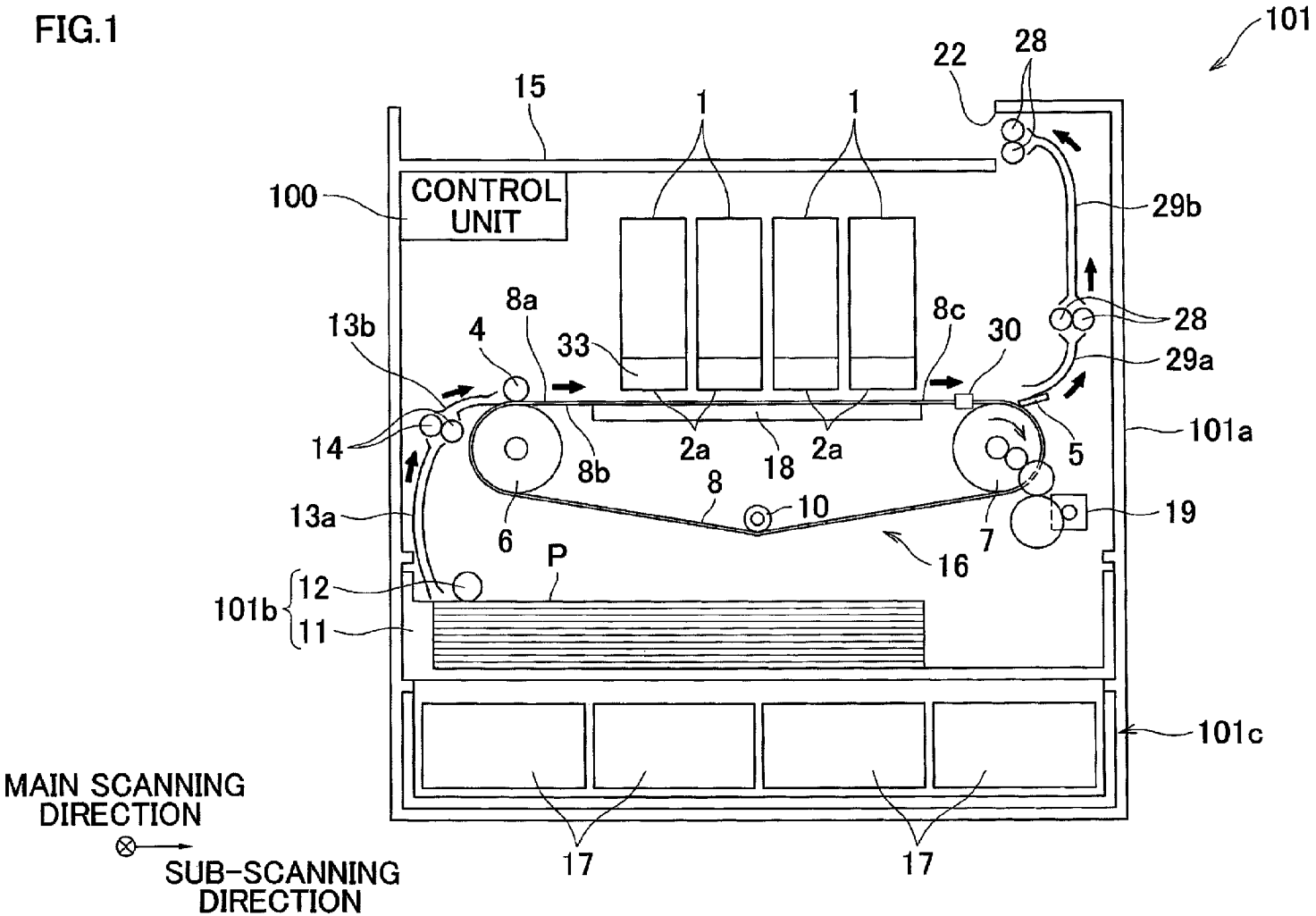
FIG. 1 schematically shows the internal structure of an inkjet printer according to First Embodiment of the present invention.

As shown in FIG. 1, an inkjet printer 101 of First Embodiment has a rectangular parallelepiped chassis 101*a*. In the chassis 101*a* are provided four inkjet heads 1 (record heads; hereinafter, heads 1) ejecting magenta, cyan, yellow, and black inks, respectively, and a conveyance mechanism 16. On the inner surface of the top plate of the chassis 101*a*, a control unit 100 is attached to control the operations of components such as the heads 1 and the conveyance mechanism 16. The upper surface of the top plate functions as a sheet discharge portion 15 to which sheets P with images are discharged. Below the conveyance mechanism 16 is provided a sheet supply unit 101*b* to be detachable to the chassis 101*a*. Below the sheet supply unit 101*b* is provided an ink tank unit 101*c* to be detachable to the chassis 101*a*.

Inside the inkjet printer 101, a conveying path is formed along the thick arrows in FIG. 1. On this conveying path, sheets P are conveyed from the sheet supply unit 101*b* toward the sheet discharge portion 15. The sheet supply unit 101*b* includes a sheet feeding tray 11 and a pickup roller 12. The sheet feeding tray 11 is an open-top box storing stacked sheets P therein. The pickup roller 12 sends out the topmost sheet P in the sheet feeding tray 11. The sheet P having been sent out is pinched by a feed roller pair 14 and guided by guides 13*a* and 13*b* to the conveyance mechanism 16.

The conveyance mechanism 16 includes two belt rollers 6 and 7, a conveyance belt 8, a tension roller 10, and a platen 18. The belt 8 is an endless belt stretched between the rollers 6 and 7 such that the inner circumferential surface 8*b* of the belt contacts the rollers 6 and 7. The tension roller 10 is biased downward and applies a tension to the belt 8 by contacting the inner circumferential surface 8*b* at the lower end portion of the belt 8. The platen 18 is provided in the space inside the belt 8, and opposes the heads 1 to prevent the belt 8 from being loosened downward. The belt roller 7 is a drive roller, and rotates clockwise in FIG. 1 as a driving force is imparted from the conveyance motor 19 to the shaft of the roller 7. The belt roller 6 is a driven roller and rotates clockwise in FIG. 1 as the belt 8 is caused to travel by the rotation of the belt roller 7. The driving force of the conveyance motor 19 is transferred to the belt roller 7 via a plurality of gears.

The outer circumferential surface 8*a* of the belt 8 is treated by silicone and hence is adhesive. To oppose the belt roller 6, a nipping roller 4 is provided. The nipping roller 4 presses a sheet P conveyed from the sheet supply unit 101*b* onto the outer circumferential surface 8*a* of the belt 8. A sheet P is conveyed in the sheet conveyance direction (rightward in FIG. 1 and in the sub-scanning direction) while being kept on the outer circumferential surface 8*a* by the adhesion of the outer circumferential surface 8*a*.

To oppose the belt roller 7, a peeling plate 5 is provided. This peeling plate 5 peels a sheet P off from the outer circumferential surface 8*a*. The peeled sheet P is conveyed while being pinched by two feed roller pairs 28 and guided by the guides 29*a* and 29*b*. The sheet P is then discharged from the discharging slot 22 at the upper part of the chassis 101*a* to a sheet discharge concave portion (sheet discharge portion) 15 at the top plate upper surface of the chassis 101*a*.

The four heads 1 eject inks of different colors (magenta, yellow, cyan, and black). Each head 1 is substantially rectangular parallelepiped and long in the main scanning direction. The heads 1 are fixed and aligned in the conveyance direction A of sheets P. In short, the printer 101 is a line-type printer and the conveyance direction A is orthogonal to the main scanning direction.

Below the heads 1 is provided a head main body 33 having a plurality of ejection openings ejecting ink. The ejection openings open at an ejection surface 2*a* which is the lower surface of the head main body 33. The ejection surface 2*a* opposes the outer circumferential surface 8*a* of the belt 8, and inks of the respective colors are serially ejected from the ejection openings toward the upper surface of the sheet P kept on and conveyed by the outer circumferential surface 8*a*, each time the sheet P passes through the region immediately below each head 1. In this way, a desired color image is formed on the upper surface of the sheet P.

The four heads 1 are connected to four ink tanks 17 in an ink tank unit 101*c*, respectively. The ink tanks 17 store the inks of different colors. Each ink tank 17 supplies ink to the head 1 via an unillustrated tube.

Figure 2:
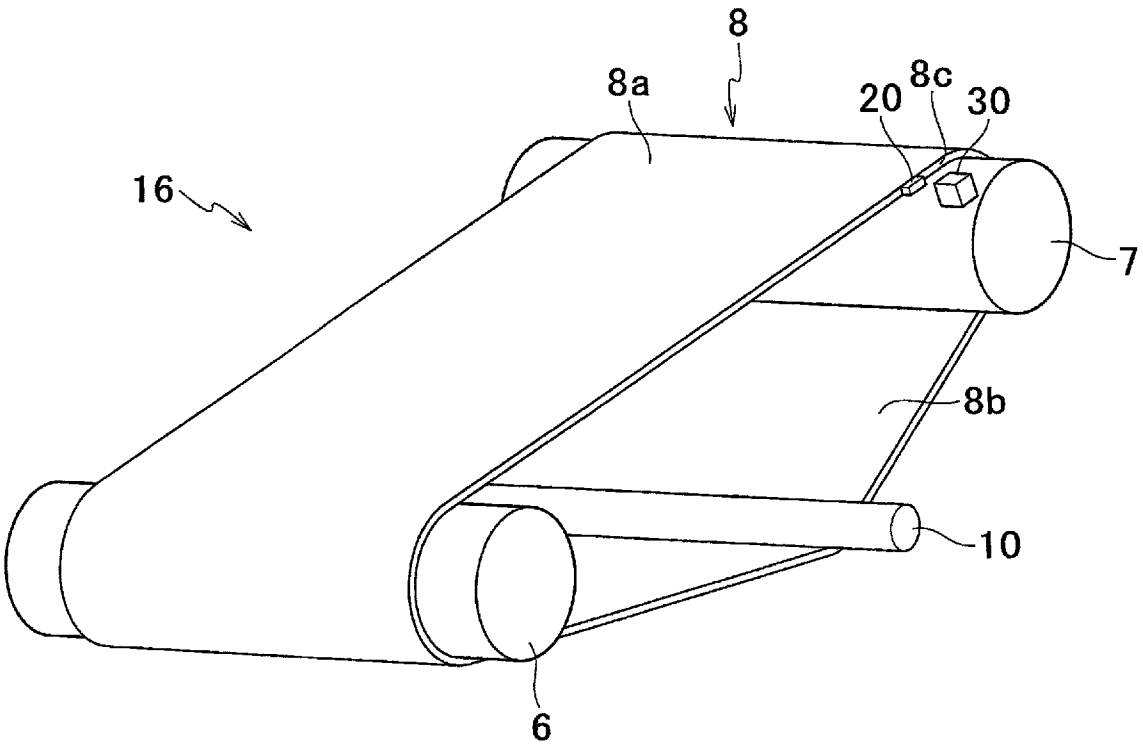
FIG. 2 is a perspective view of a conveyance mechanism (excluding a platen) of the inkjet printer of FIG. 1, a mark on the conveyance belt, and a mark sensor.

As shown in FIGS. 1 and 2, at the profile 8*c* of the belt 8 is arranged (attached or adhered in this embodiment) a mark 20. The mark 20 therefore moves with the belt 8 as the belt 8 travels. At a position which is upstream of the belt roller 6 and downstream of the belt roller 7 in the direction of the travel of the belt 8 and downstream of the region opposing the ejection surface 2*a* of the head 1, a mark sensor 30 is provided to oppose the profile 8*c* where the mark 20 is arranged. The mark sensor 30 determines whether the mark 20 which moves in accordance with the travel of the belt 8 exists at a predetermined position. (This operation will be described hereinafter as "to detect the mark".) The predetermined position in the present embodiment is a position opposing the light emitting element 30*a*, i.e., a position which is upstream of the belt roller 6 and downstream of the belt roller 7 in the direction of the travel of the belt 8 and downstream of the region opposing the ejection surface 2*a* of the head 1. The mark sensor 30 can detect that the mark 20 is at this position.

Figure 3:
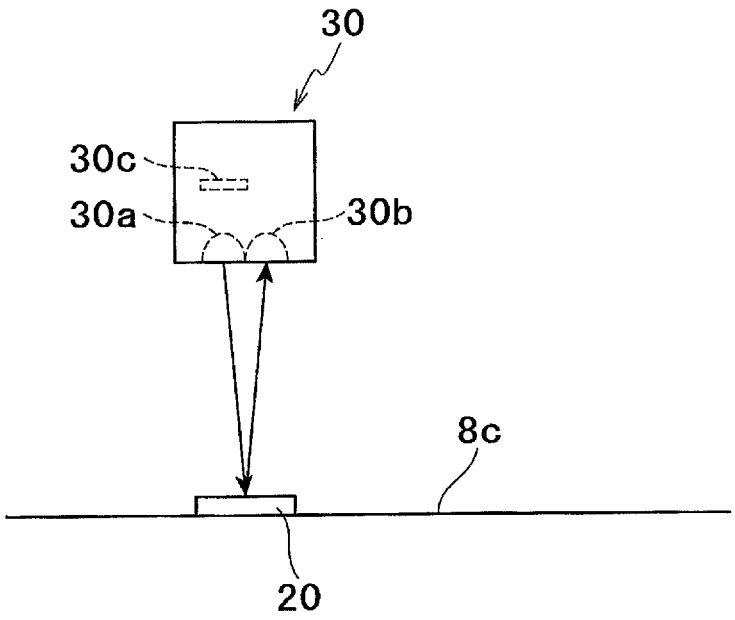
FIG. 3 shows how the mark sensor of FIG. 1 detects the mark.

As shown in FIG. 3, the mark sensor 30 is a reflective optical sensor including a light emitting element 30*a*, a light receiving element 30*b*, and a light quantity control circuit 30*c*. The light emitting element 30*a* is a light emitting diode (LED) which emits light to the profile 8*c* where the mark 20 is arranged. When the mark 20 reaches the position (predetermined position) opposing the light emitting element 30*a*, the light from the light emitting element 30*a* is reflected on the mark 20, and the reflected light reaches the light receiving element 30*b*. Receiving the reflected light, the light receiving element 30*b* converts the optical signal into an electric signal, and outputs the signal to the control unit 100 as a detected signal value. The mark 20 is detected in this way. In connection with the above, the light quantity control circuit 30*c* is capable of changing the quantity of light emitted from the light emitting element 30*a* by changing the current value supplied to the light emitting element 30*a*. In the present embodiment, the detected signal value output from the light receiving element 30*b* monotonically increases as the quantity of light from the light emitting element 30*a* increases.

It is noted that the profile 8*c* of the belt 8 has a different reflectance from that of the mark 20, and hence the light emitted from the light emitting element 30*a* and reflected by the profile 8*c* does not reach the light receiving element 30*b*.

As the mark 20 is detected as above, it is possible, for example, to fix the region of the belt 8 to which region ink is ejected from the ejection openings of the head 1 at the time of flushing.

Figure 4:
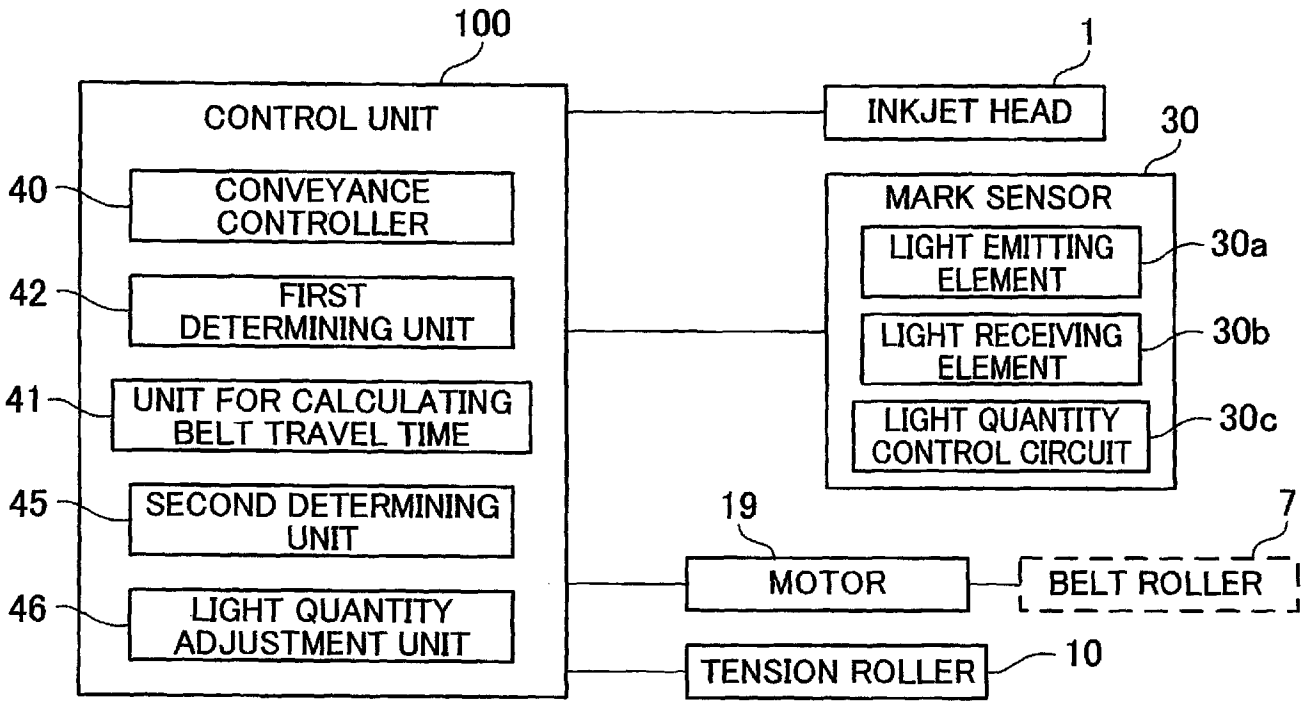
FIG. 4 is a functional block diagram of the inkjet printer of FIG. 1.

Referring back to FIG. 1, the inkjet printer 101 includes the control unit 100. This control unit 100 controls the operations of the components of the inkjet printer 101. The control unit 100 is constituted by a plurality of hardware devices such as a CPU (Central Processing Unit), a RAM (Random Access Memory), and a ROM (Read Only Member). The ROM stores different kinds of software for controlling the inkjet printer 101. As the software cooperates with the hardware devices in the control unit 100, in the control unit 100 as shown in FIG. 4 are structured a conveyance controller 40, first determining unit 42, a unit 41 for calculating a belt travel time, a second determining unit 45, and a light quantity adjustment unit 46. In addition to the above, the control unit 100 performs various processes including the control of the operations of the heads 1.

The conveyance controller 40 controls a motor 19 which is a driving source of the belt roller 7.

The first determining unit 42 determines whether a detected signal value not lower than a predetermined value T1 has been output from the light receiving element 30*b* of the mark sensor 30. The predetermined value T1 is a threshold for detecting the mark. The determination by the first determining unit 42 that a detected signal value not lower than the predetermined value T1 has been output indicates that the mark 20 has been detected.

The unit 41 calculates a belt travel time which is either a time elapsed from the timing at which the belt 8 starts to travel at constant speed after the power source of the inkjet printer 101 is turned on or a time elapsed from the timing at which the quantity of light is increased by the light quantity adjustment unit 46.

The second determining unit 45 determines whether the belt travel time calculated by the unit 41 is longer than a predetermined time t. In the present embodiment, the predetermined time t is a time required for moving the mark 20 from a position to the same position when the belt 8 travels at constant speed.

The light quantity adjustment unit 46 increases the value of the current supplied to the light emitting element 30*a* in increments of a predetermined value v via controlling the light quantity control circuit 30*c*. In this way, the quantity of light from the light emitting element 30*a* is increased. It is noted that the quantity of light from the light emitting element 30*a* does not linearly change in accordance with changes in the value of the current supplied to the light emitting element 30*a*. The quantity is saturated when the current value reaches a certain degree. For this reason, the increase in the quantity of light from the light emitting element 30*a* is not always the same when the current value is increased by the predetermined value v.

Now, a mark detection process in the inkjet printer 101 of First Embodiment will be described with reference to the flowchart in FIG. 5.

As the power source of the inkjet printer 101 is turned on, the belt 8 starts to travel in response to the control of the motor 19 by the conveyance controller 40 in the step S1.

Then in the step S2, the first determining unit 42 determines whether a detected signal value not lower than the predetermined value T1 has been output from the light receiving element 30*b* of the mark sensor 30. When it is determined that the detected signal value not lower than the predetermined value T1 has been output (S2: YES), the determination indicates that the mark 20 is properly detected, and the mark detection process is terminated. On the other hand, if it is determined that the detected signal value not lower than the predetermined value T1 has not been output (S2: NO), the process proceeds to the step S3.

In the step S3, the second determining unit 45 determines whether the belt travel time calculated by the unit 41 is longer than the predetermined time t. This belt travel time is a time elapsed from the timing at which the belt 8 starts to travel at constant speed in the step S1. When it is determined that the belt travel time is not longer than the predetermined time t (S3: NO), the process goes back to the step S2. When it is determined that the belt travel time is longer than the predetermined time t (S3: YES), the process proceeds to the step S4.

In the step S4, the light quantity adjustment unit 46 increases the quantity of light from the light emitting element 30*a* by increasing, via controlling the light quantity control circuit 30*c*, the value of the current supplied to the light emitting element 30*a* by the predetermined value v. Thereafter, in the step S5, the first determining unit 42 determines whether the light receiving element 30*b* has output a detected signal value not lower than the predetermined value T1. When it is determined that the detected signal value not lower than the predetermined value T1 has been output (S5: YES), the determination indicates that the detection of the mark 20 is properly carried out on account of the increase in the light quantity in the step S4, and hence the mark detection process is terminated. When it is determined that the detected signal value not lower than the predetermined value T1 has not been output (S5: NO), the process proceeds to the step S6.

In the step S6, the second determining unit 45 determines whether the belt travel time calculated by the unit 41 is longer than the predetermined time t. This belt travel time is a time elapsed from each timing of the latest increase in the light quantity in the step S4. If it is determined that the belt travel time is not longer than the predetermined time t (S6: NO), the process goes back to the step S5. If it is determined that the belt travel time is longer than the predetermined time t (S6: YES), the process goes back to the step S4.

As described above, according to First Embodiment, the mark 20 is arranged not on the inner circumferential surface 8*b* but on the profile 8*c* of the belt 8, and it is therefore possible to, for example, restrain the wear of the mark 20 due to the contact with the belt rollers 6 and 7 and with the tension roller 10. Furthermore, since the mark 20 is arranged not on the outer circumferential surface 8*a* but on the profile 8*c* of the belt 8, it is possible to, for example, restrain the adherence of foreign matters such as ink and toner ejected from the heads 1 onto the mark 20. Thanks to the above, the decrease in the detectivity of the mark 20 is restrained, and hence the mark 20 is properly detected.

In addition to the above, since the mark 20 having different reflectance from that of the profile 8*c* of the belt 8 is arranged on the profile 8*c* of the belt 8, it is unnecessary to carry out complicated operations, for example forming the belt 8 while embedding the mark 20 therein.

In addition to the above, the degree of vibration of the belt 8 is low at around the rollers 6 and 7. In the present embodiment, since the mark 20 is detected at a position near the roller 7, the detection of the mark 20 is done at a position where the degree of vibration of the belt 8 and the mark 20 is low. This makes it possible to detect the mark 20 further properly.

At a position which is upstream of the roller 7 which is a drive roller and downstream of the roller 6 which is a driven roller along the direction of the travel of the belt 8, the belt 8 is drawn by the roller 7. In the meanwhile, at a position which is downstream of the roller 7 and upstream of the roller 6 in the direction of the travel of the belt 8, the belt 8 is forwarded by the roller 7. The region in the belt 8 which region is drawn is not highly deformed as compared to the region which is forwarded. Therefore the vibration of the belt 8 is not strong at this drawn region. In the present embodiment, since the mark 20 is detected at a position upstream of the roller 7 and downstream of the roller 6, the detection of the mark 20 is carried out while the vibration of the belt 8 and the mark 20 is not significant. This makes it possible to detect the mark 20 further properly.

The belt 8 severely vibrates at the lower half portion which is downstream of the roller 7 and upstream of the roller 6 in the direction of the travel of the belt 8, i.e. the portion where the belt 8 contacts the tension roller 10. This is because of the movement of the tension roller 10. According to the present embodiment, the detection of the mark 20 is carried out not at this position but at a position upstream of the roller 7 and downstream of the roller 6. It is therefore possible to carry out the detection of the mark 20 while the vibration of the belt 8 and the mark 20 is not significant. This makes it possible to detect the mark 20 further properly.

The deformation of the belt 8 is not significant particularly at a position around the roller 7, which is upstream of the roller 7 in the direction of the travel of the belt 8 and downstream of the region opposing the ejection surface 2*a* of the head 1. In other words, the vibration of the belt 8 is significantly small at this position. According to the present embodiment, since the detection of the mark 20 is carried out at this position, it is possible to carry out the detection of the mark 20 while the vibration of the belt 8 and the mark 20 is not significant. This makes it possible to detect the mark 20 further properly.

In addition to the above, when the mark 20 is not properly detected because of reasons such as the degradation of the mark 20 due to the adhesion of foreign matters and/or the wear of the mark 20 and the decrease in the light receiving sensitivity of the light receiving element 30*b*, the quantity of light emitted from the light emitting element 30*a* is increased. This makes it easy to achieve the proper detection of the mark 20 only by increasing the quantity of light from the light emitting element 30*a*.

Now, referring to FIGS. 6 to 10, Second Embodiment which is a modification of the embodiment above will be described. It is noted that the same components as in the embodiment above are denoted by the same reference numerals as in the embodiment, and the description thereof will be omitted.

Figure 7:
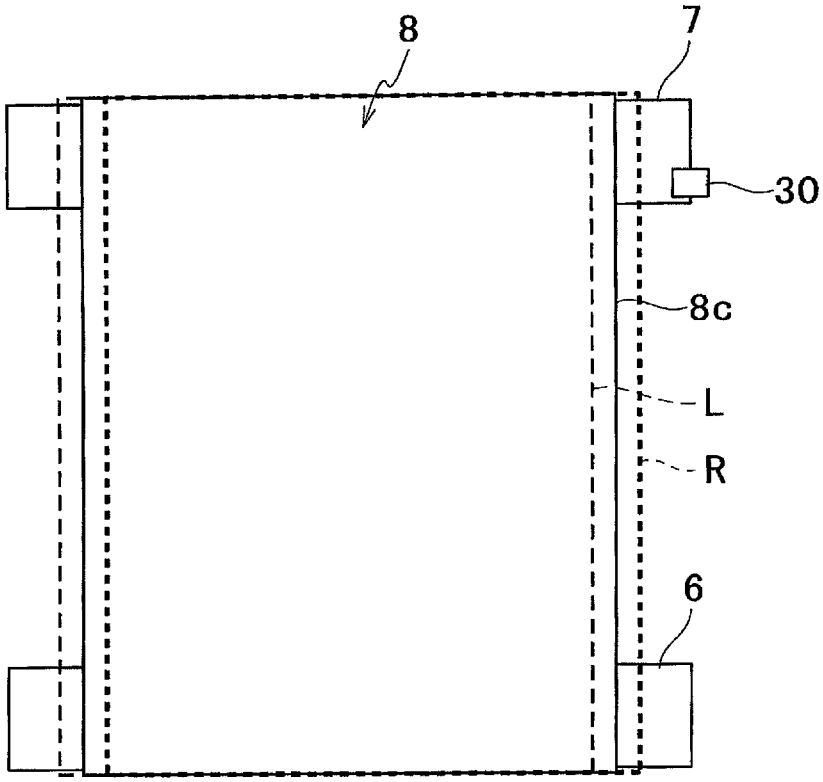
FIG. 7 shows the movement of the conveyance belt in the axial direction of the belt roller shown in FIG. 6.

An inkjet printer 201 of Second Embodiment further includes a belt position sensor 25 which detects the position of the belt 8 in the axial directions of the belt roller 7, i.e. the directions in which the profile 8*c* of the belt 8 approaches and is distanced from the light emitting element 30*a*. As shown in FIG. 7, the belt 8 is capable of traveling to, for example, a position indicated by the broken line L and a position indicated by the broken line R, in the axial direction of the belt roller 7. In other words, the belt 8 is capable of traveling in the directions in which the profile 8*c* of the belt 8 and the light emitting element 30*a* of the mark sensor 30 get close to each other and are distanced from each other. While traveling, changes in the position of the belt 8 are inevitable although to different extents. The positional control of the belt 8 is achieved by tilting the tension roller 10. More specifically, on the plane in parallel to the ejection surface 2*a* and the shaft of the tension roller 10, at least one of the edges of the tension roller 10 is moved to tilt the tension roller 10 with respect to the rollers 6 and 7.

Figure 6:
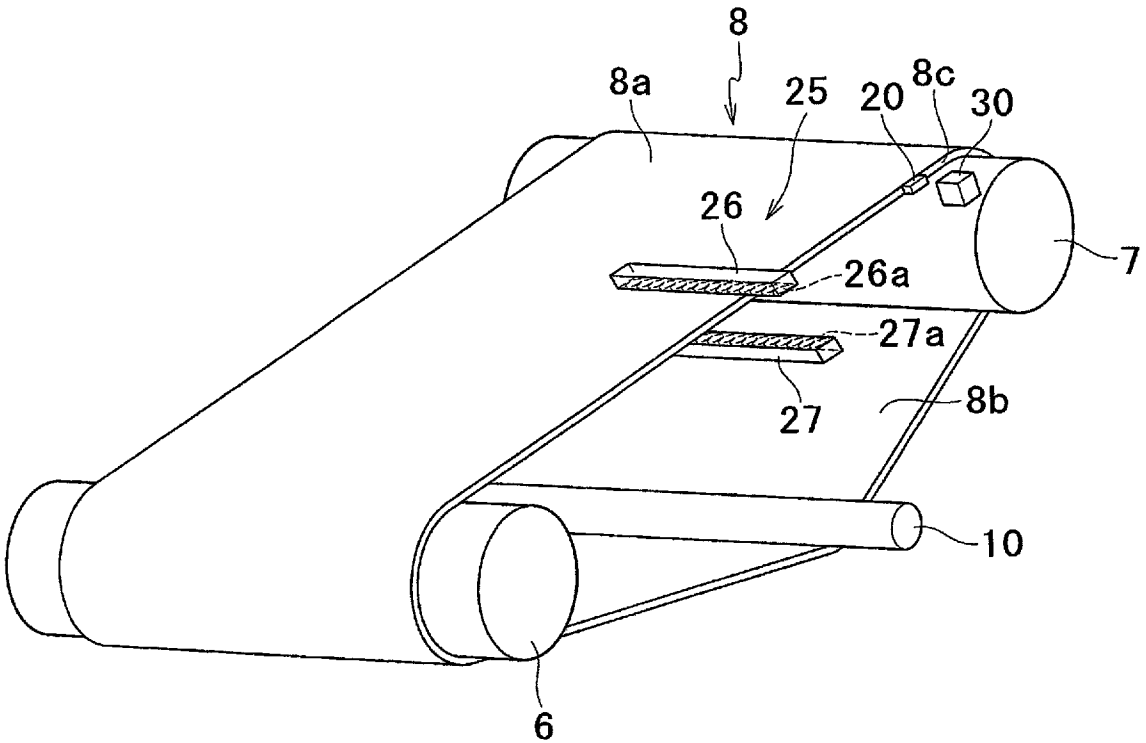
FIG. 6 is a perspective view of a conveyance mechanism (excluding a platen) of an inkjet printer of Second Embodiment of the present invention, a mark on the conveyance belt, a mark sensor, and a belt position sensor.

As shown in FIG. 6, the belt position sensor 25 has a light emitting unit 26 above the belt 8 and a light receiving unit 27 below the belt 8, and the light emitting unit 26 and the light receiving unit 27 are arranged to sandwich the belt 8. The light emitting unit 26 and the light receiving unit 27 extend to be in parallel to the axial directions of the belt roller 7, and have the same lengths. The light emitting unit 26 includes a plurality of light emitting elements 26*a* aligned in the axial directions of the belt roller 7, whereas the light receiving unit 27 includes a plurality of light receiving elements 27*a* aligned in the axial directions of the belt roller 7. The light emitting elements 26*a* and the light receiving elements 27*a* are aligned in the thickness direction of the belt 8 so as to form a plurality of pairs in each of which the elements 26*a* and 27*a* oppose each other. This allows the light receiving element 27*a* to receive light emitted from the corresponding light emitting element 26*a*.

According to this arrangement, the number of the plurality of pairs of the light emitting elements 26*a* and the light receiving elements 27*a* sandwiching the belt 8 is varied in accordance with the position of the belt 8. In other words, it is possible to detect the position of the belt 8 by grasping the number of light receiving elements 27*a* receiving light from the light emitting elements 26*a*.

It is noted that the belt position sensor 25 may be provided at any positions as long as it has the above-described arrangement, can detect the position of the belt 8 in the axial directions of the belt roller 7, and does not interfere the heads 1.

Figure 8:
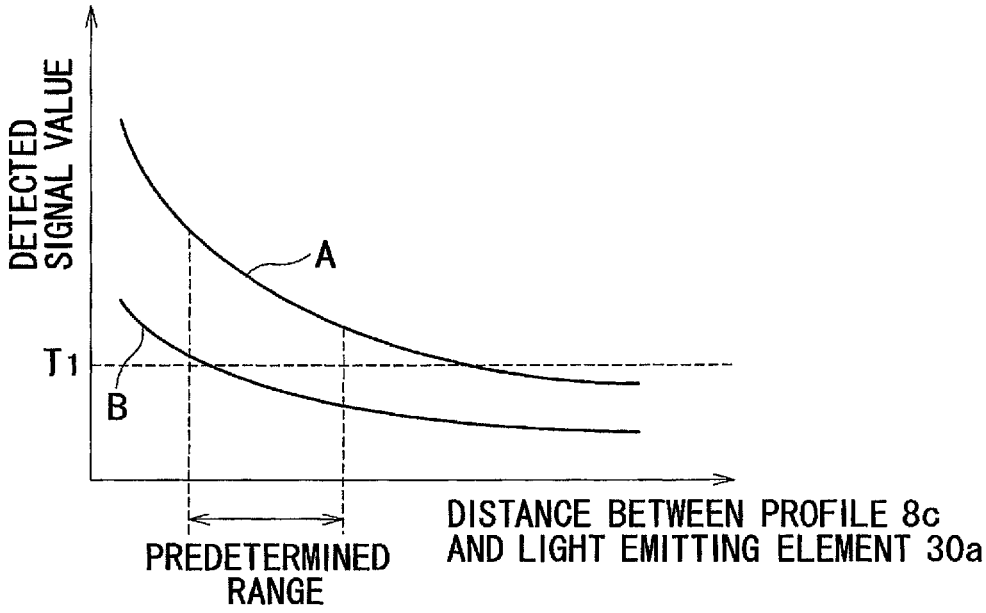
FIG. 8 is a graph showing changes in a detected signal value output from a light receiving element in accordance with changes in the position of the conveyance belt shown in FIG. 6 and changes in an amount of light emitted from a light emitting element.

Referring to FIG. 8, the following will describe changes in the detected signal value output from the light receiving element 30*b* in accordance with the changes in the position of the belt 8. In FIG. 8, the vertical axis indicates the detected signal value output from the light receiving element 30*b* whereas the horizontal axis indicates the distance between the profile 8*c* of the belt 8 and the light emitting element 30*a* in the axial directions of the belt roller 7. The curve A indicates changes in the detected signal value output from the light receiving element 30*b* when the light emitting element 30*a* emits a predetermined quantity of light. This predetermined quantity of light is the quantity of light from the light emitting element 30*a* when the inkjet printer 101 is in the initial state. The curve B indicates changes in the detected signal value output from the light receiving element 30*b*, when the detected signal value output from the light receiving element 30*b* is decreased as compared to the case of the curve A on account of, for example, the degradation of the mark 20 and/or the decrease in the light receiving sensitivity of the light receiving element 30*b*, in case where the light emitting element 30*a* emits the predetermined quantity of light. When the quantity of light from the light emitting element 30*a* is increased from the predetermined quantity, each detected signal value output from the light receiving element 30*b* becomes higher than the detected signal values indicated by the curve A.

When the quantity of light from the light emitting element 30*a* is constant, the detected signal value output from the light receiving element 30*b* monotonically decreases as the distance from the profile 8*c* to the light emitting element 30*a* increases. In other words, when the quantity of light from the light emitting element 30*a* is constant, the detected signal value output from the light receiving element 30*b* monotonically increases as the belt 8 gets closer to the light emitting element 30*a*. The detected signal value output from the light receiving element 30*b* monotonically increases as the quantity of light from the light emitting element 30*a* increases, at each position on the belt 8.

Figure 9:
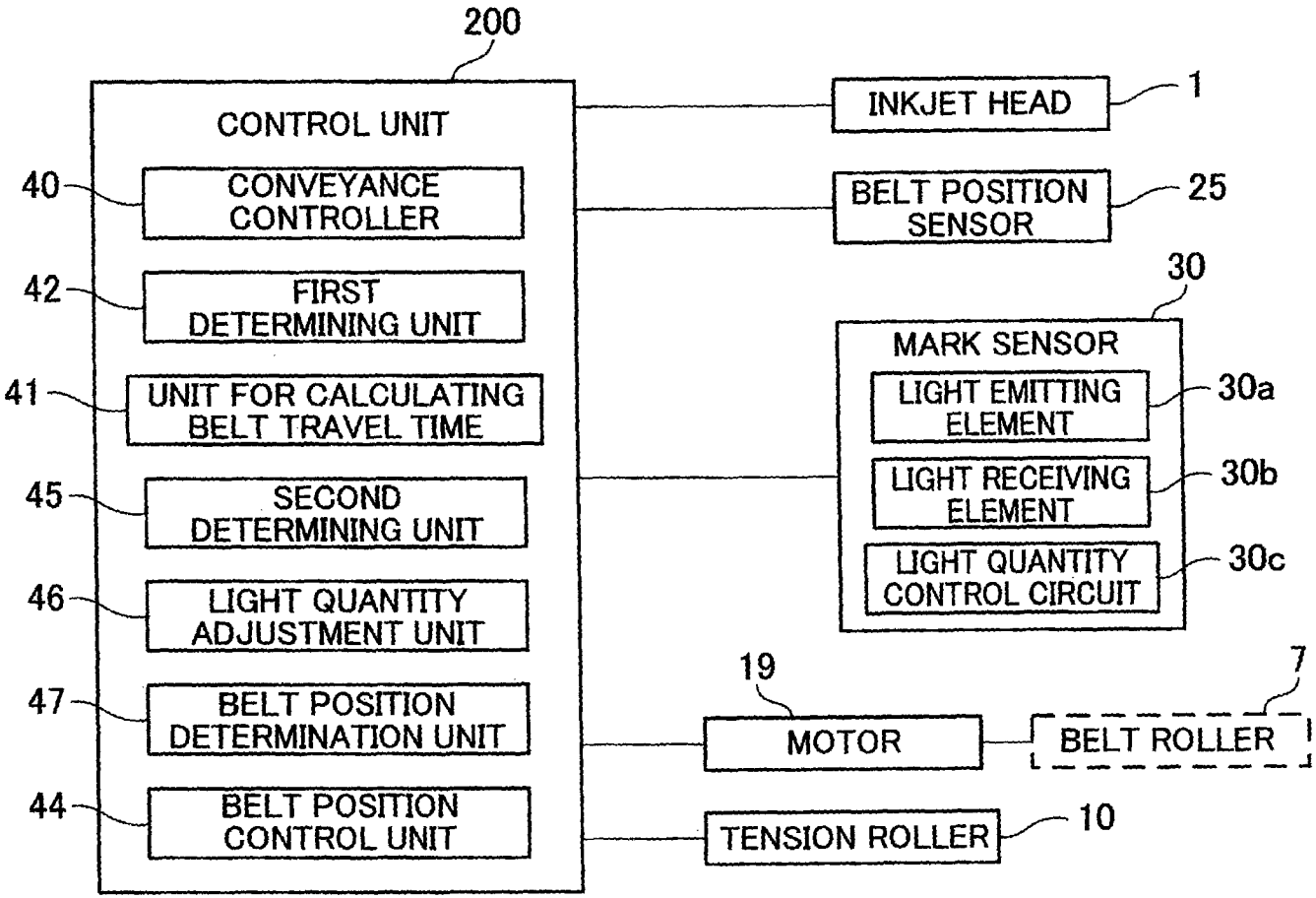
FIG. 9 is a functional block diagram of the inkjet printer according to Second Embodiment of the present invention.

As shown in FIG. 9, in the control unit 200 of the inkjet printer 201 according to Second Embodiment are further structured a belt position determination unit 47 and a belt position control unit 44 in addition to the components of the control unit 100 shown in FIG. 4.

The belt position determination unit 47 determines whether the position of the belt 8 detected by the belt position sensor 25 falls within a predetermined position range. This predetermined position range is suitably defined. The range is preferably arranged so that the belt 8 is positioned around the center of the belt roller 7 in the axial directions of the belt roller 7. As shown in FIG. 8, when the light emitting element 30*a* emits the predetermined quantity of light, the detected signal value is higher than the predetermined value T1 irrespective of the position of the belt 8 in the predetermined position range. The belt position determination unit 47 also determines whether the position of the belt 8 detected by the belt position sensor 25 is farther from the light emitting element 30*a* of the mark sensor 30 than the predetermined position range.

The belt position control unit 44 moves the belt 8 in the axial directions of the belt roller 7 via controlling the inclination of the tension roller 10. More specifically, the belt position control unit 44 moves the belt 8 to be close to or far from the light emitting element 30*a* of the mark sensor 30, until the belt position sensor 25 detects that the belt 8 has moved to fall within the predetermined position range. The belt position control unit 44 includes an unillustrated mechanism for tilting the tension roller 10.

In the present embodiment, the unit 41 calculates the belt travel times from the start of the constant travel of the belt 8 after the power source of the inkjet printer 201 is turned on, from each timing at which the light quantity adjustment unit 46 increases the light quantity, and from the timing at which the belt position control unit 44 moves the belt 8.

Now, a mark detection process in the inkjet printer 201 according to Second Embodiment will be described with reference to the flowchart of FIG. 10.

As the power source of the inkjet printer 201 is turned on, the steps S1 to S3 are carried out in the same manner as First Embodiment. If it is determined in the step S3 that the belt travel time is not longer than the predetermined time t (S3: NO), the process goes back to the step S2. If it is determined that the belt travel time is longer than the predetermined time t (S3: YES), the process proceeds to the step S7.

In the step S7, the belt position determination unit 47 determines whether the position of the belt 8 detected by the belt position sensor 25 falls within the predetermined position range. If it is determined that the position of the belt 8 falls within the predetermined position range (S7: YES), the process proceeds to the step S8. If it is determined that the position of the belt 8 does not fall within the predetermined position range (S7: NO), the process proceeds to the step S11.

In the step S8, the light quantity adjustment unit 46 increases, via controlling the light quantity control circuit 30*c*, the quantity of light from the light emitting element 30*a* by increasing the value of the current supplied to the light emitting element 30*a* by the predetermined value v. Thereafter, in the step S9, the first determining unit 42 determines whether the detected signal value not lower than the predetermined value T1 has been output from the light receiving element 30*b*. If it is determined that the detected signal value not lower than the predetermined value T1 has been output (S9: YES), it is indicated that the detection of the mark 20 is properly carried out as a result of the increase in the light quantity in the step S8, and hence the mark detection process is terminated. If it is determined that the detected signal value not lower than the predetermined value T1 has not bee output (S9: NO), the process proceeds to the step S10.

In the step S10, the second determining unit 45 determines whether the belt travel time calculated by the unit 41 is longer than the predetermined time t. This belt travel time is a time elapsed from each timing of the latest increase in the light quantity in the step S8. If it is determined that the belt travel time is not longer than the predetermined time t (S10: NO), the process goes back to the step S9. If it is determined that the belt travel time is longer than the predetermined time t (S10: YES), the process goes back to the step S8.

In the step S11, the belt position determination unit 47 determines whether the position of the belt 8 detected by the belt position sensor 25 is farther from the light emitting element 30*a* of the mark sensor 30 than the predetermined position range. When it is determined that the position of the belt 8 is further from the light emitting element 30*a* than the predetermined position range (S11: YES), the belt position control unit 44 moves the belt 8 to be closer to the light emitting element 30*a* of the mark sensor 30 in the step S12 until the belt position sensor 25 detects that the position of the belt 8 falls within the predetermined position range. The process then proceeds to the step S14. If it is determined that the position of the belt 8 is not farther from the light emitting element 30*a* than the predetermined position range (S11: NO), i.e. if it is determined that the position of the belt 8 is closer to the light emitting element 30*a* than the predetermined position range, the belt position control unit 44 moves the light emitting element 30*a* of the mark sensor 30 away from the belt 8 in the step S13 until the belt position sensor 25 detects that the position of the belt 8 falls within the predetermined position range. The process them proceeds to the step S14.

In the step S14, the first determining unit 42 determines whether the light receiving element 30*b* has output a detected signal value not lower than the predetermined value T1. If it is determined that the detected signal value not lower than the predetermined value T1 has been output (S14: YES), the determination result indicates that it becomes possible to properly detect the mark 20 as a result of the lateral movement of the belt 8 in the step S12 or S13, and hence the mark detection process is terminated. If it is determined that the detected signal value not lower than the predetermined value T1 has not been output (S14: NO), the process proceeds to the step S15.

In the step S15, the second determining unit 45 determines whether the belt travel time calculated by the unit 41 is longer than the predetermined time t. This belt travel time is a time elapsed from the timing of the latest movement of the belt 8 in the step S12 or S13. If it is determined that the belt travel time is not longer than the predetermined time t (S15: NO), the process goes back to the step S14. If it is determined that the belt travel time is longer than the predetermined time t (S15: YES), the process proceeds to the step S16.

In the step S16, the light quantity adjustment unit 46 increases the quantity of light from the light emitting element 30*a* by increasing, via controlling the light quantity control circuit 30*c*, the value of the current supplied to the light emitting element 30*a* by the predetermined value v. Thereafter, in the step S17, the first determining unit 42 determines whether the light receiving element 30*b* has output a detected signal value not lower than the predetermined value T1. If it is determined that the detected signal value not lower than the predetermined value T1 has been output (S17: YES), the determination result indicates that the proper detection of the mark 20 becomes possible on account of the increase in the light quantity in the step S16, and hence the mark detection process is terminated. If it is determined that the detected signal value not lower than the predetermined value T1 has not been output (S17: NO), the process goes back to the step S16.

As described above, the present embodiment is arranged so that, provided that the quantity of light from the light emitting element 30*a* is constant, the detected signal value output from the light receiving element 30*b* monotonically increases as the belt 8 gets close to the light emitting element 30*a*. For this reason, when the belt 8 is moved away from the light emitting element 30*a* in the step S13, the detected signal value is further decreased on account of the lateral movement of the belt 8. In such a case, the process may skip the steps S14-S15 and proceed to the step S16.

As described above, according to Second Embodiment, even when the position of the belt 8 falls within the predetermined position range, the detected signal value output from the light receiving element 30*b* may be lower than the predetermined value T1. Such a case occurs when, for example, changes in the detected signal value become identical with those indicated by the curve B on account of the degradation of the mark 20 due to the adherence of foreign matters and/or the wear of the mark 20 and the decrease in the light receiving sensitivity of the light receiving element 30*b*. In such a case, the detection of the mark 20 while keeping the position of the belt 8 to fall within the predetermined position range is easily achieved by increasing the quantity of light from the light emitting element 30*b*.

When the mark 20 is not properly detected, the belt 8 is moved to be closer to the light emitting element 30*a* or away from the light emitting element 30*a* when the position of the belt 8 is farther from or closer to the light emitting element 30*a* than the predetermined position range, respectively. As such, the detection of the mark 20 is carried out after the position of the belt 8 is suitably adjusted and then the quantity of light from the light emitting element 30*a* is increased. When the proper detection of the mark 20 is realized by adjusting the position of the belt 8 (i.e. when the result of the step S14 is YES after the step S12), it is unnecessary to adjust the quantity of light from the light emitting element 30*a*.

Now, referring to FIGS. 11 and 12, Third Embodiment which is a modification of the embodiments above will be described. It is noted that the same components as in the embodiments above are denoted by the same reference numerals as in the embodiments, and the description thereof will be omitted.

Figure 11:
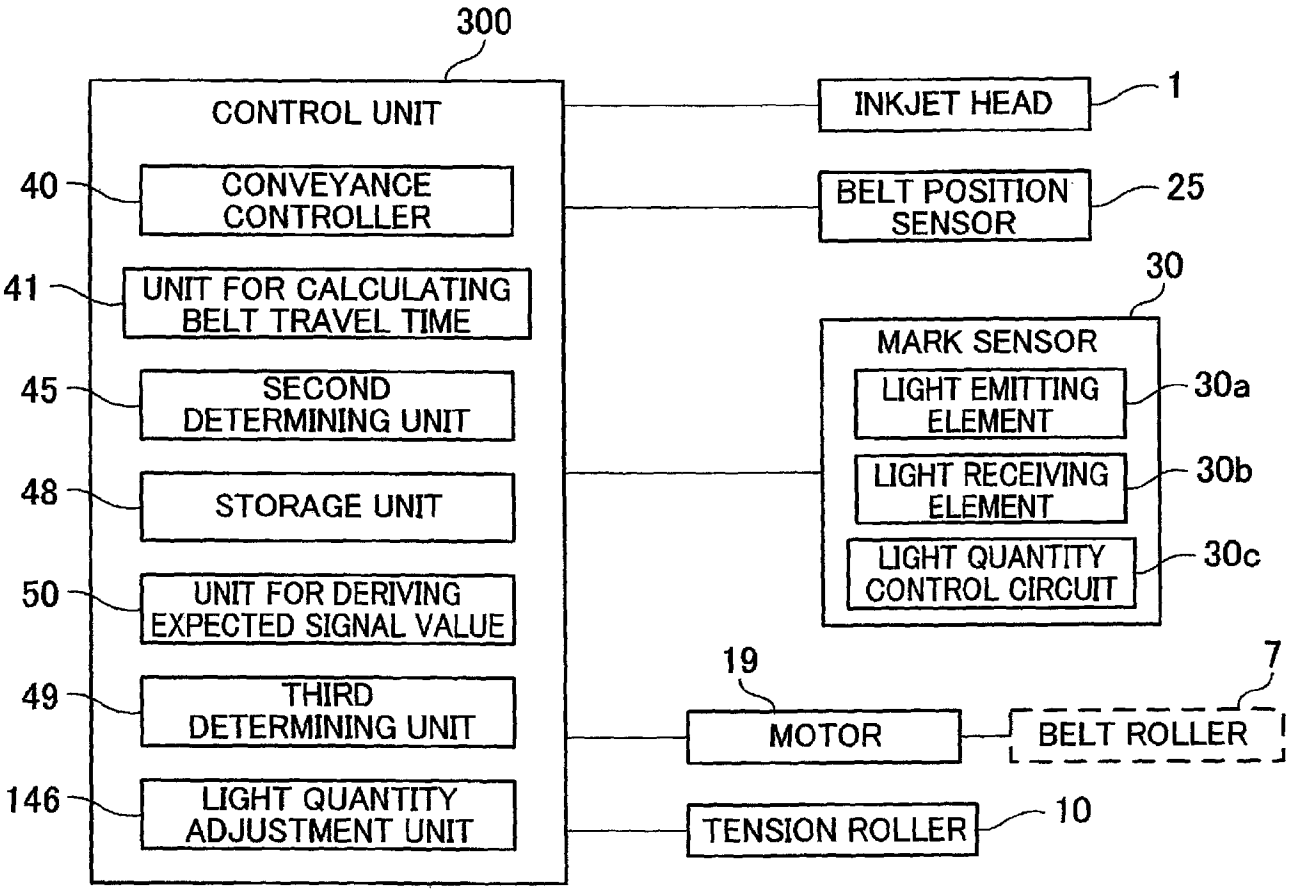
FIG. 11 is a functional block diagram of an inkjet printer according to Third Embodiment of the present invention.
Figure 12:
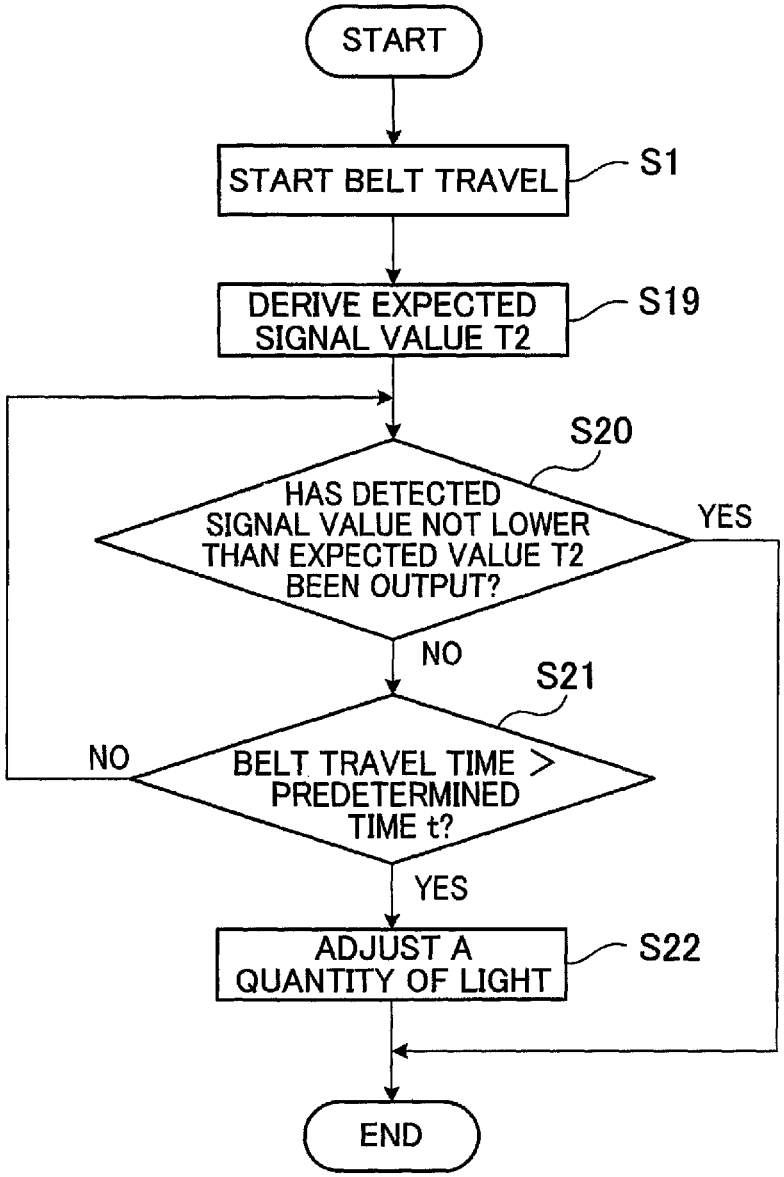
FIG. 12 is a flowchart of a detected signal value adjustment process of the inkjet printer according to Third Embodiment of the present invention.

As shown in FIG. 11, in a control unit 300 of an inkjet printer 301 according to Third Embodiment are provided a storage unit 48, an expected signal value deriving unit 50, a third determining unit 49, and a light quantity adjustment unit 146, in addition to the conveyance controller 40, the unit 41, and the second determining unit 45.

The storage unit 48 stores sensor property information indicating changes in the detected signal value output from the light receiving element 30*b* in accordance with positional changes of the belt 8 and with changes in the quantity of light from the light emitting element 30*a*. Although FIG. 8 shows only the curve A in the case of the predetermined light quantity of the light emitting element 30*a*, the storage unit 48 also stores sets of sensor property information in cases of other quantities of light from the light emitting element 30*a*. This indicates that, as the quantity of light from the light emitting element 30*a* is determined, the curve indicating the changes in the detected signal value at that quantity of light in accordance with the positional changes of the belt 8 is uniquely determined. In other words, an expected signal value T2 of the detection signal output from the light receiving element 30*b* is derivable, when the current quantity of light from the light emitting element 30*a* and the current position of the belt 8 are grasped.

The expected signal value deriving unit 50 derives the expected signal value T2 of the detection signal output from the light receiving element 30*b* with reference to the position of the belt 8 detected by the belt position sensor 25, the quantity of light from the light emitting element 30*a*, and the sensor property information stored in the storage unit 48.

The third determining unit 49 determines whether the light receiving element 30*b* of the mark sensor 30 has output the detected signal value not lower than the expected signal value T2 derived by the expected signal value deriving unit 50.

The light quantity adjustment unit 146 increases, via controlling the light quantity control circuit 30*c*, the quantity of light from the light emitting element 30*a* until the detection signal output from the light receiving element 30*b* reaches the expected signal value T2.

Now, a detected signal value adjustment process in the inkjet printer 301 according to Third Embodiment will be described with reference to the flowchart in FIG. 12.

As the power source of the inkjet printer 301 is turned on, in the step S1, the travel of the belt 8 is started in response to the control of the motor 19 by the conveyance controller 40.

Thereafter, in the step S19, the expected signal value deriving unit 50 derives the expected signal value T2 of the detection signal output from the light receiving element 30*b*, with reference to the position of the belt 8 detected by the belt position sensor 25, the quantity of light from the light emitting element 30*a*, and the sensor property information stored in the storage unit 48.

Then in the step S20, the third determining unit 49 determines whether the light receiving element 30*b* of the mark sensor 30 has output the detected signal value not lower than the expected signal value T2 derived by the expected signal value deriving unit 50. If it is determined that the detected signal value not lower than the expected signal value T2 has been output (S20: YES), the detected signal value adjustment process is terminated. If it is determined that the detected signal value not lower than the expected signal value T2 has not been output (S20: NO), the process proceeds to the step S21.

In the step S21, the second determining unit 45 determines whether the belt travel time calculated by the unit 41 is longer than the predetermined time t. This belt travel time is a time elapsed from the start of the constant travel of the belt 8 in the step S1. If it is determined that the belt travel time is not longer than the predetermined time t (S21: NO), the process goes back to the step S20. If it is determined that the belt travel time is longer than the predetermined time t (S21: YES), the process proceeds to the step S22.

In the step S22, the light quantity adjustment unit 146 increases, by means of the light quantity control circuit 30*c*, the quantity of light from the light emitting element 30*a* until the detection signal output from the light receiving element 30*b* reaches the expected signal value T2. The detected signal value adjustment process is then terminated.

Figure 5:
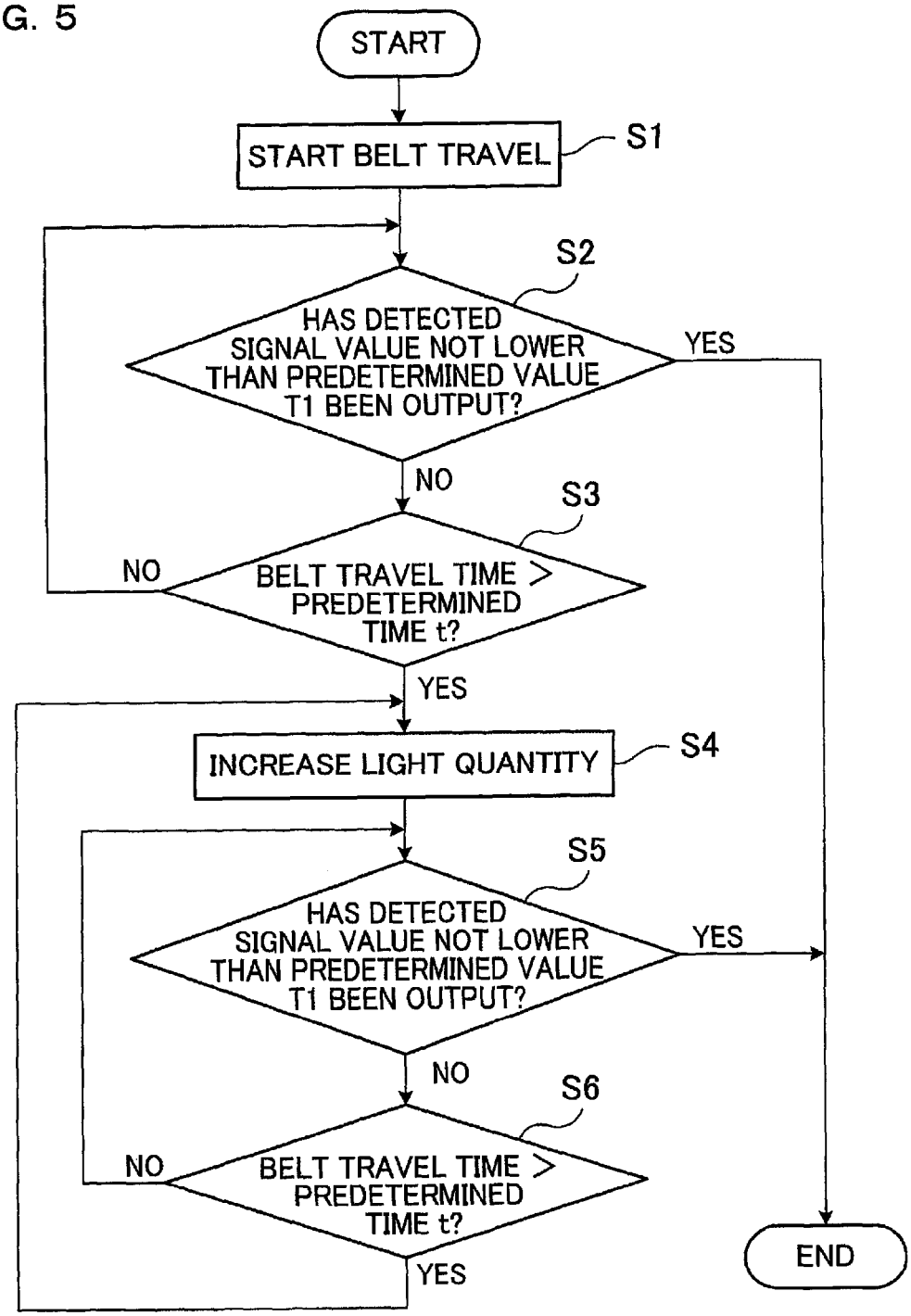
FIG. 5 is a flowchart of a mark detection process of the inkjet printer of FIG. 1.
Figure 10:
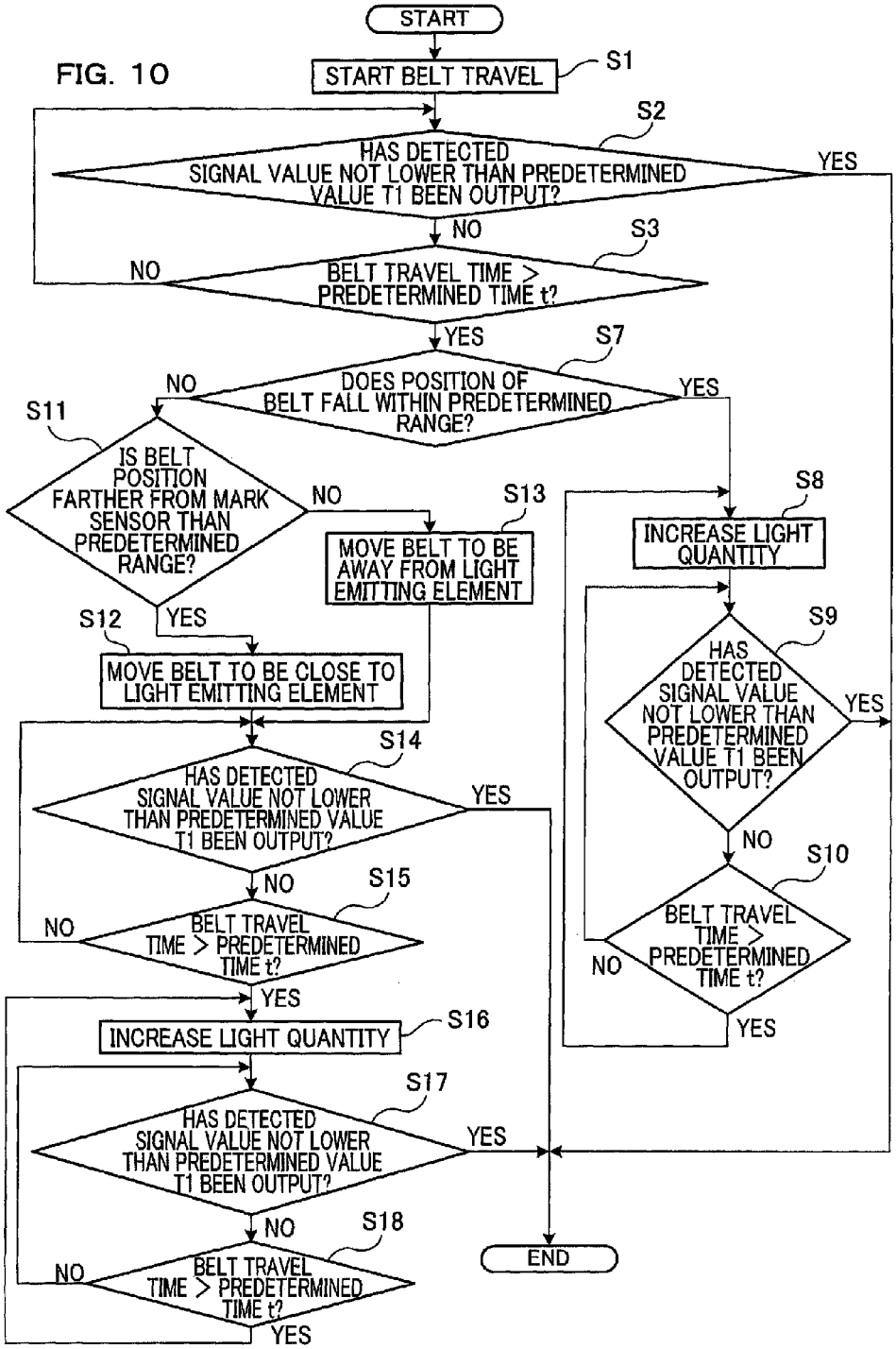
FIG. 10 is a flowchart of a mark detection process of the inkjet printer according to the Second Embodiment of the present invention.

It is noted that a mark detection process shown in FIG. 5 or FIG. 10 may be carried out after the detected signal value adjustment process above is carried out and the detected signal value output from the light receiving element 30*b* is adjusted. In this case the mark detection process is carried out after the inkjet printer 301 becomes in a suitable state on account of the adjustment of the detected signal value output from the light receiving element 30*b*.

As described above, according to Third Embodiment, the detected signal value of the light receiving element 30*b* may be smaller than the expected signal value T2 due to the degradation of the mark 20 on account of the adherence of foreign matters and the wear of the mark 20 and the decrease in the light receiving sensitivity of the light receiving element 30*b*. In such a case, the mark 20 may not be properly detected even if, for example, the position of the belt 8 falls within the predetermined position range. To solve this problem, the quantity of light from the light emitting element 30*a* is increased when the detected signal value output from the light receiving element 30*b* is smaller than the expected signal value T2. As such, the mark 20 is properly detected by adjusting the output detected signal value so as to suitably adjust the state of the inkjet printer 301.

In the embodiments above, any types of belts can be used as the belt 8 as long as they are endless. Such endless belts include seamless belts and jointed belts formed by joining the ends of belts. In the embodiments above, the detection of the mark 20 is carried out for fixing a region on the conveyance belt to which region ink is ejected during flushing. The present invention, however, may be used for other purposes. For example, when the conveyance belt has a joint, the mark 20 may be detected to grasp the position of the joint on the conveyance belt in order to prevent a sheet P from being placed at the joint of the conveyance belt. In the embodiments above, the belt 8 is adhesive and the sheets P are conveyed by utilizing the adhesion of the outer circumferential surface 8*a*. The present invention, however, is not limited to this arrangement. The belt 8 may suck sheets P onto the outer circumferential surface 8*a* by an electrostatic force or an air suction force to convey the sheets P.

The present invention can be used for any types of recording apparatuses recording images, and the recording apparatuses are not limited to inkjet printers. The present invention may be used for laser printers, for example.

In the embodiment above, the mark sensor 30 detects that the mark 20 is at a predetermined position. The predetermined position is a position which is upstream of the belt roller 6 and downstream of the belt roller 7 in the direction of the travel of the belt 8 and is downstream of the region opposing the ejection surface 2*a* of the head 1. The predetermined position, however, is not limited to the above. The predetermined position may be a position close to one of the belt rollers 6 and 7 when the conveyance mechanism 16 does not have the tension roller 10 and the belt 8 is stretched between two belt rollers 6 and 7. The position close to one of the belt rollers may be a position upstream or downstream of the belt roller 6 or 7 in the direction of the travel of the belt. The predetermined position may also be a position upstream of the belt roller 6 and downstream of the belt roller 7 in the direction of the travel of the belt 8.

In the embodiments above, the mark sensor 30 is provided at a position which is upstream of the belt roller 6 and downstream of the belt roller 7 in the direction of the travel of the belt 8 and downstream of the region opposing the ejection surface 2*a* of the head 1. The position of the mark sensor 30, however, is not limited to this. The position of the mark sensor 30 may be arbitrarily determined on condition that the mark at the predetermined position is detectable. The means for detecting the mark is not limited to the mark sensor 30 which is an optical sensor. As long as the mark is detected, the mark sensor 30 may be a magnetic sensor.

In the embodiment above, the unit 41 calculates the belt travel times from the start of the constant travel of the belt 8, from each timing at which the light quantity adjustment unit 46 increases the light quantity, and from the timing at which the belt position control unit 44 moves the belt 8. In this regard, the timings to start the calculation of the belt travel time are not limited to the above. The unit 41 may calculate the belt travel time at a timing later than the timings above.

In First Embodiment, to adjust the detected signal value output from the light receiving element 30*b*, the quantity of light from the light emitting element 30*a* is increased in the step S4 in FIG. 5. Alternatively, the belt 8 may be moved to be close to the light emitting element 30*a* instead of increasing the quantity of light from the light emitting element 30*a*.

In the embodiments above, the detected signal value output from the light receiving element 30*b* monotonically increases as the belt 8 gets close to the light emitting element 30*a*, and monotonically decreases as the quantity of light from the light emitting element 30*a* increases. In this connection, when, for example, the mark sensor 30 is at a certain position, the detected signal value may monotonically decreases as the belt 8 gets close to the light emitting element 30*a* or may monotonically decreases as the quantity of light from the light emitting element 30*a* increases. In such cases, as a matter of course, the quantity of light from the light emitting element 30*a* is not increased but decreased in, for example, the step S4 in FIG. 5.

In addition to the above, when, for example, the light emitting element 30*a* and the light receiving element 30*b* are provided at different positions as different components, the tendency of changes in the detected signal value in accordance with the changes in the position of the belt 8 may not be monotonic increase or monotonic decrease. For example, the tendency of changes in the detected signal value is changed when the belt 8 is at a position I. That is to say, when the belt 8 is farther from the light emitting element 30*a* than the position I, the detected signal value monotonically increases as the belt 8 gets close to the light emitting element 30*a*, whereas, when the belt 8 is closer to the light emitting element 30*a* than the position I, the detected signal value monotonically decreases as the belt 8 gets close to the light emitting element 30*a*. In such a case, for example, the sensor property information indicating the changes in the detected signal value is stored in the storage unit or the like, and the direction of the travel of the belt 8 is determined in accordance with the position of the belt 8 detected by the belt position sensor 25 and the sensor property information, when the mark is not detected.

In addition to the above, before the step S4 in FIG. 5, a step of determining whether the quantity of light from the light emitting element 30*a* has reached the upper limit m may be carried out, and the mark detection process is terminated if the quantity has reached the upper limit m. In this case, if the result of the step S6 is YES, the process goes back to the step of determining whether the quantity of light from the light emitting element 30*a* has reached the upper limit m. This makes it possible to avoid to repeat the step S4 when the mark has not been detected for some reason even if the quantity of light from the light emitting element 30*a* has already reached the upper limit m. Similarly, the step above may be carried out before the step S16 or before the step S8 in FIG. 10.

The embodiments above have been described on the premise that the mark sensor 30 is an analog output sensor. In this regard, the mark sensor 30 may be a digital output sensor. In such a case, in the steps S2 and S5 in FIG. 5 and in the steps S2, S9, S14, and S17 in FIG. 10, the first determining unit 42 determines whether the detection signal indicating the detection of the mark 20 has been output from the mark sensor 30, instead of determining whether the detected signal value not lower than the predetermined value T1 has been output from the light receiving element 30*b* of the mark sensor 30.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus comprising:

a recording unit recording an image;

an endless belt stretched between a plurality of rollers so that an inner circumferential surface of the belt contacts the plurality of rollers whereas an outer circumferential surface of the belt opposes the recording unit;

a mark which is arranged on a profile of the belt;

a mark detection unit which detects that the mark moving in accordance with travel of the belt is positioned at a predetermined position, wherein the mark has a reflectance different from a reflectance of the profile of the belt, and wherein the mark detection unit is a reflective sensor which is provided to oppose the profile and has a light emitting unit and a light receiving unit; and a control unit which increases a quantity of light emitted from the light emitting unit when a time during which the mark detection unit does not detect that the mark is at the predetermined position becomes greater than a predetermined time.

2. The recording apparatus according to claim 1, wherein, the predetermined position is a position close to one of the plurality of rollers.

3. The recording apparatus according to claim 1, wherein, the plurality of rollers include a drive roller and a driven roller, and the predetermined position is a position upstream of the drive roller and downstream of the driven roller in a direction of travel of the belt.

4. The recording apparatus according to claim 3, further comprising:

a tension roller which contacts the belt at a position downstream of the drive roller and upstream of the driven roller in the direction of the travel and adjusts the tension of the belt.

5. The recording apparatus according to claim 3, wherein the belt conveys the recording medium provided on the outer circumferential surface, when traveling from the driven roller to the drive roller, the recording unit opposes the belt at a region upstream of the drive roller and downstream of the driven roller in the direction of the travel, and the predetermined position is a position downstream of the region where the recording unit opposes the belt, in the direction of the travel.

6. A recording apparatus comprising:

a recording unit recording an image;

an endless belt stretched between a plurality of rollers so that an inner circumferential surface of the belt contacts the plurality of rollers whereas an outer circumferential surface of the belt opposes the recording unit;

a mark which is arranged on a profile of the belt;

a mark detection unit which detects that the mark moving in accordance with travel of the belt is positioned at a predetermined position, wherein the mark has a reflectance different from a reflectance of the profile of the belt, and wherein the mark detection unit is a reflective sensor which is provided to oppose the profile and has a light emitting unit and a light receiving unit;

a belt position detection unit which detects a position of the belt in directions in which the profile of the belt and the light emitting unit move toward and away from each other; and a control unit which increases a quantity of light emitted from the light emitting unit when a time during which the mark detection unit does not detect that the mark is at the predetermined position becomes greater than a predetermined time and the position of the belt detected by the belt position detection unit falls within a predetermined range.

7. A recording apparatus comprising:

a recording unit recording an image;

an endless belt stretched between a plurality of rollers so that an inner circumferential surface of the belt contacts the plurality of rollers whereas an outer circumferential surface of the belt opposes the recording unit;

a mark which is arranged on a profile of the belt;

a mark detection unit which detects that the mark moving in accordance with travel of the belt is positioned at a predetermined position, wherein the mark has a reflectance different from a reflectance of the profile of the belt, and wherein the mark detection unit is a reflective sensor which is provided to oppose the profile and has a light emitting unit and a light receiving unit;

a belt position detection unit which detects a position of the belt in directions in which the profile of the belt and the light emitting unit move toward and away from each other; and a control unit which moves the belt to be close to the light emitting unit when the position of the belt detected by the belt position detection unit is farther from the light emitting unit than a predetermined range and moves the belt away from the light emitting unit when the position of the belt is closer to the light emitting unit than the predetermined range, when a time during which the mark detection unit does not detect that the mark is at the predetermined position becomes greater than a predetermined time.

8. A recording apparatus comprising:

a recording unit recording an image;

an endless belt stretched between a plurality of rollers so that an inner circumferential surface of the belt contacts the plurality of rollers whereas an outer circumferential surface of the belt opposes the recording unit;

a mark which is arranged on a profile of the belt;

a mark detection unit which detects that the mark moving in accordance with travel of the belt is positioned at a predetermined position, wherein the mark has a reflectance different from a reflectance of the profile of the belt, and wherein the mark detection unit is a reflective sensor which is provided to oppose the profile and has a light emitting unit and a light receiving unit;

a storage unit which stores sensor property information indicating a change in a detected signal value which is output from the light receiving unit in accordance with a change in the position of the belt;

a belt position detection unit which detects a position of the belt in directions in which the profile of the belt and the light emitting unit move toward and away from each other; and a control unit which increases a quantity of light emitted from the light emitting unit when the detected signal value output from the light receiving unit is less than an expected signal value derived based on the position of the belt detected by the belt position detection unit and the sensor property information.

* * * * *